US008036566B2

(12) United States Patent
Kamijo et al.

(10) Patent No.: US 8,036,566 B2
(45) Date of Patent: Oct. 11, 2011

(54) CONTROL METHOD OF IMAGE FORMING APPARATUS AND IMAGE FORMING APPARATUS

(75) Inventors: Koichi Kamijo, Matsumoto (JP); Satoshi Chiba, Suwa (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 640 days.

(21) Appl. No.: 12/140,124

(22) Filed: Jun. 16, 2008

(65) Prior Publication Data

US 2009/0016766 A1 Jan. 15, 2009

(30) Foreign Application Priority Data

Jul. 12, 2007 (JP) ..... 2007-182788
Mar. 17, 2008 (JP) ..... 2008-067358

(51) Int. Cl.
*G03G 15/00* (2006.01)
*G03G 15/10* (2006.01)
*G03G 15/14* (2006.01)
*G03G 21/00* (2006.01)

(52) U.S. Cl. ..... 399/101; 399/237; 399/302; 399/308

(58) Field of Classification Search ..... 399/101, 399/237, 239, 249, 302, 308
See application file for complete search history.

(56) References Cited

U.S. PATENT DOCUMENTS

| | | | | |
|---|---|---|---|---|
| 5,970,278 | A * | 10/1999 | Munakata | 399/46 |
| 6,269,228 | B1 * | 7/2001 | Kayahara et al. | 399/37 |
| 7,392,008 | B2 * | 6/2008 | Takahashi | 399/346 |
| 7,809,307 | B2 * | 10/2010 | Fukumoto et al. | 399/101 |
| 2007/0140738 | A1 * | 6/2007 | Aruga et al. | 399/237 |
| 2007/0140739 | A1 * | 6/2007 | Aruga et al. | 399/249 |

FOREIGN PATENT DOCUMENTS

| | | | |
|---|---|---|---|
| JP | 2001312148 | A * | 11/2001 |
| JP | 2001337572 | A * | 12/2001 |
| JP | 2002-268394 | | 9/2002 |
| JP | 2002-287517 | | 10/2002 |

* cited by examiner

*Primary Examiner* — David Gray
*Assistant Examiner* — Fred L Braun
(74) *Attorney, Agent, or Firm* — DLA Piper LLP (US)

(57) ABSTRACT

A control method and an image forming apparatus. The apparatus includes a latent image carrier; a development apparatus for developing a liquid developer containing a toner, a carrier liquid and a dispersant soluble in the carrier liquid therein on the latent image carrier; an intermediate transfer medium to which a developer image developed on the latent image carrier is transferred; a transfer apparatus for transferring the developer image on the intermediate transfer medium to a transfer material; and a dispersant collecting liquid application unit for applying a dispersant collecting liquid on the intermediate transfer medium. The method includes performing the control such that after finishing of transfer of the developer image onto intermediate transfer medium, application of the dispersant collecting liquid on the intermediate transfer medium is started by the dispersant collecting liquid application unit.

8 Claims, 8 Drawing Sheets

CONTROL METHOD OF IMAGE FORMING APPARATUS AND IMAGE FORMING APPARATUS

CROSS REFERENCE TO RELATED APPLICATION

The disclosure of Japanese Patent Applications No. 2007-182788 filed on Jul. 12, 2007 and No. 2008-67358 filed on Mar. 17, 2008 including specification, drawings and claims is incorporated herein by reference in its entirety.

BACKGROUND

1. Technical Field

The present invention relates to a control method of a development apparatus for developing an electrostatic latent image formed on a latent image carrier such as photoconductors with a liquid developer composed of a toner, a carrier liquid and a dispersant and to an image forming apparatus. In more detail, the invention relates to a control method of an image forming apparatus such as a copier, a printer and a facsimile by transferring a developed liquid developer image on a latent image carrier onto a transfer material such as paper to obtain an image and to an image forming apparatus.

2. Related Art

In an image forming apparatus using a liquid developer, there is proposed an image forming apparatus for recovering chiefly a toner by cleaning for the purpose of recovering an excessive toner by an excessive toner collecting unit and making a liquid carrier remain on a photoconductor (see, for example, JP-A-2002-268394).

Also, for the purpose of suppressing the generation of an excessive toner, there is proposed a method for cleaning a liquid developer by a polyurethane-made cleaning blade or the like (see, for example, JP-A-2002-287517).

However, in the case where a toner is recovered by cleaning at the finishing time of printing to make a carrier liquid remain on a latent image carrier, since wettability of the surface of the latent image carrier is affected by a dispersant remaining in the carrier liquid on a photoconductor, there is caused unevenness in concentration of a developing solution on the latent image carrier at the time of subsequent development.

Also, in the case when printing is finished in a state that the carrier liquid is made to remain on the latent image carrier, the carrier liquid flowed downward due to gravity, thereby causing a fault of contaminating the inside of the apparatus. Also, in the case where cleaning is performed using a cleaning blade, the dispersant remained on the latent image carrier together with a part of the carrier liquid, and characteristics of the developing solution changed at the time of subsequent development, thereby possibly causing unevenness in concentration.

SUMMARY

An advantage of some aspects of the invention is to prevent the generation of a phenomenon in which as a result of the matter that a dispersant contained in a liquid developer remains on a latent image carrier, development characteristics change due to the dispersant remained during development of a latent image to cause a phenomenon such as unevenness in concentration of an image to be formed, thereby deteriorating the quality of the image.

According to an aspect of the invention, there is provided a control method of an image forming apparatus including a latent image carrier; a development apparatus for developing a liquid developer containing a toner, a carrier liquid and a dispersant soluble in the carrier liquid therein on the latent image carrier; an intermediate transfer medium to which a developer image developed on the latent image carrier is transferred; a transfer apparatus for transferring the developer image on the intermediate transfer medium to a transfer material; and a dispersant collecting liquid application unit for applying a dispersant collecting liquid on the intermediate transfer medium, which includes performing the control such that after finishing of transfer of the developer image onto intermediate transfer medium, application of the dispersant collecting liquid on the intermediate transfer medium is started by the dispersant collecting liquid application unit. Thus, even in the case where the dispersant which is soluble in the carrier liquid remains without being removed by an intermediate transfer medium cleaning apparatus or remains on the intermediate transfer medium, by applying a liquid in which the dispersant in the developer is soluble onto the intermediate transfer medium, the dispersant can be surely removed together with the dispersant collecting liquid after dissolving and diluting the dispersant on the latent image carrier.

According to another aspect of the invention, there is provided a control method of an image forming apparatus, wherein transfer rollers are controlled such that they are separated from the intermediate transfer medium during a time after transferring the developer image onto the intermediate transfer medium until starting the application of the dispersant collecting liquid on the intermediate transfer medium by the dispersant collecting liquid application unit. Thus, the liquid in which the dispersant is soluble does not deposit on the transfer rollers, and a problem such as deposition of the application liquid on the transfer material such as paper is not caused.

According to a further aspect of the invention, there is provided a control method of an image forming apparatus, wherein separation between the transfer rollers is continued until an action for removing the dispersant by the application of the dispersant collecting liquid is finished. Thus, it is possible to prevent contamination of the transfer material to be caused due to deposition of the dispersant collecting liquid on the transfer rollers.

According to a still further aspect of the invention, there is provided a control method of an image forming apparatus, wherein after finishing of the transfer from the latent image carrier to the intermediate transfer medium, a rotating speed of the intermediate transfer medium is faster than a rotating speed of the intermediate transfer medium at the time of transferring the developer image from the latent image carrier to the intermediate transfer medium. In this way, in the case where the speed of the intermediate transfer medium is faster than that at the time of transfer from the latent image carrier to the intermediate transfer medium, the amount of movement of the dispersant collecting liquid applied on the intermediate transfer medium onto the contacting latent image carrier is small, and a major part of the liquid applied on the intermediate transfer medium can be kept. Thus, it is possible to effectively remove the dispersant on the intermediate transfer medium.

According to a still further aspect of the invention, there is provided a control method of an image forming apparatus, wherein the latent image carrier is separated from the intermediate transfer medium before an application starting position of the dispersant collecting liquid applied by the dispersant liquid collecting liquid application unit on the intermediate transfer medium reaches a transfer part for transferring the intermediate transfer medium developer image from the latent image carrier.

In this way, by separating the latent image carrier, it is possible to prevent the movement of the liquid applied by the application unit into the side of the latent image carrier.

According to a still further aspect of the invention, there is provided a control method of an image forming apparatus, wherein after rotating in a state that the latent image carrier and the intermediate transfer medium come into contact with each other until the dispersant collecting liquid is applied on the latent image carrier one or more rounds, the dispersant collecting liquid is applied on the intermediate transfer medium by rotating the intermediate transfer medium one or more rounds while separating the latent image carrier and the intermediate transfer medium from each other.

In this way, when after removing the residue of the liquid developer from the intermediate transfer medium by the intermediate transfer medium cleaning apparatus by making the intermediate transfer medium one round from a rear end of the image forming position, the liquid in which the dispersant is soluble is applied, an effect for removing the dispersant by the dispersant collecting liquid can be enhanced.

According to a still further aspect of the invention, there is provided an image forming apparatus including a latent image carrier; a development apparatus in which rotatable development rollers for conveying a liquid developer containing a toner for developing an electrostatic latent image, a carrier liquid and a dispersant which is soluble in the carrier liquid develop a latent image of the latent image carrier; a rotatable intermediate transfer medium to which a developer image on the latent image carrier is transferred; an intermediate transfer medium cleaning apparatus for cleaning the intermediate transfer medium; and an application unit for applying a dispersant collecting liquid on the intermediate transfer medium. Thus, the dispersant on the intermediate transfer medium can be removed by the intermediate transfer medium cleaning apparatus after application by the application unit for applying the dispersant collecting liquid in which the dispersant in the liquid developer is soluble, dissolving and diluting.

BRIEF DESCRIPTION OF THE DRAWINGS

The invention will be described with reference to the accompanying drawings, wherein like numbers reference like elements.

DESCRIPTION OF EXEMPLARY EMBODIMENTS

Best modes for carrying out the invention are hereunder described with reference to the accompanying drawings.

Figure 1:
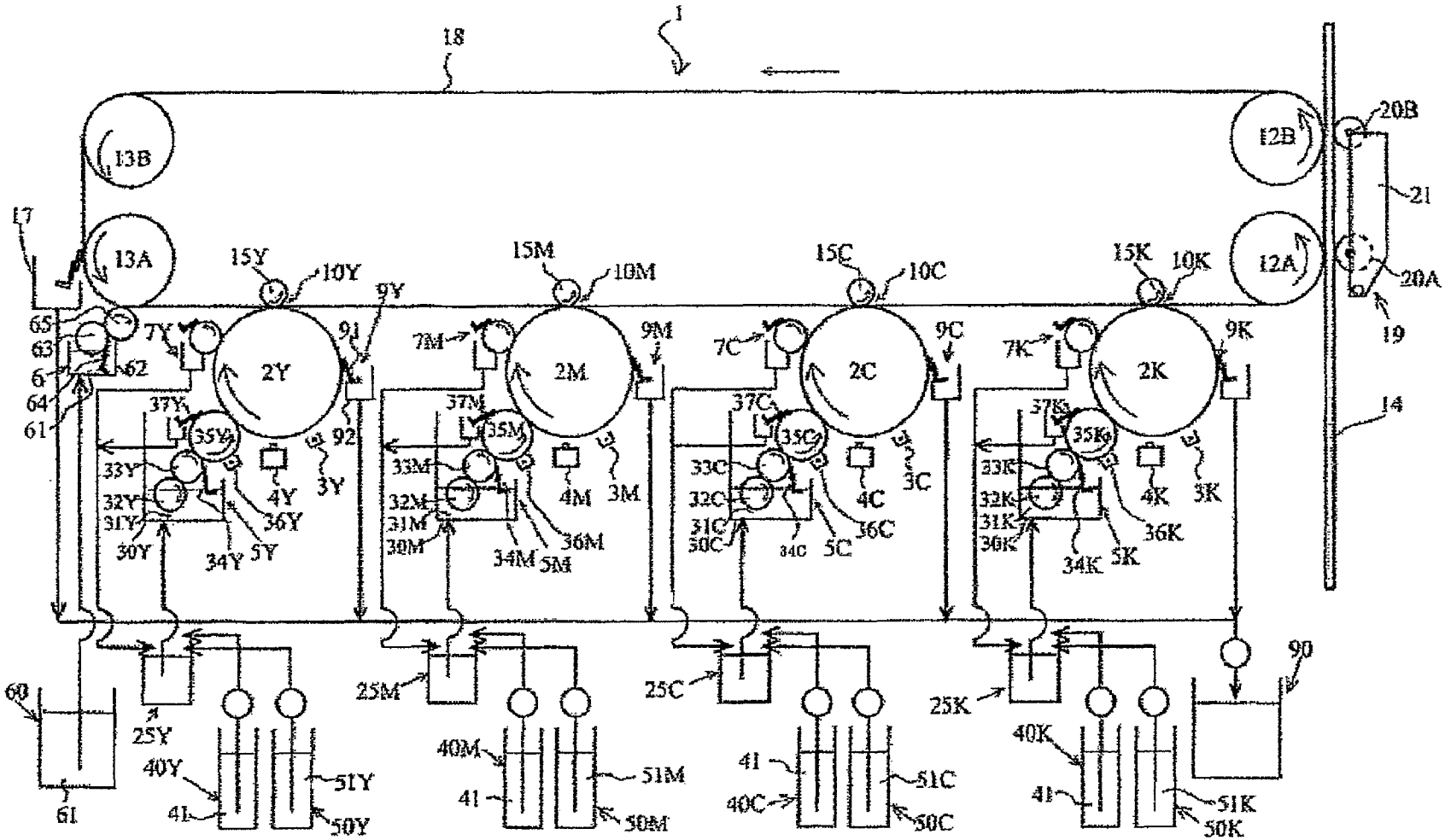
FIG. 1 is a view partially showing an embodiment of an image forming apparatus according to the invention.

FIG. 1 is a view partially showing an embodiment of an image forming apparatus according to the invention.

In an image forming apparatus 1 of this embodiment, photoconductors 2Y, 2M, 2C and 2K as latent image carriers of yellow (Y), magenta (M), cyan (C) and black (K), respectively are disposed in a tandem type in the development order.

In the respective photoconductors 2Y, 2M, 2C and 2K, 2Y represents a yellow photoconductor; 2M represents a magenta photoconductor; 2C represents a cyan photoconductor; and 2K represents a black photoconductor. As to other members, Y, M, C and K of respective colors are similarly added to symbols of the members, thereby expressing the members of each color.

In the embodiment as shown in FIG. 1, all of the respective photoreceptors 2Y, 2M, 2C and 2K are configured of a photoconductive drum. Each of the photoreceptors 2Y, 2M, 2C and 2K can also be configured in an endless belt form.

At the time of working, all of these photoreceptors 2Y, 2M, 2C and 2K are clockwise rotated as shown by arrows in FIG. 1. In order that charge of the photoconductor, exposure, development, transfer to an intermediate transfer medium removal of a toner remaining on the photoconductor may be successively performed, charge members 3Y, 3M, 3C and 3K; exposure apparatuses 4Y, 4M, 4C and 4K; development apparatuses 5Y, 5M, 5C and 5K; squeeze units 7Y, 7M, 7C and 7K for removing a carrier liquid in a liquid developer as excessively deposited on the surface of the photoreceptor; transfer apparatuses 10Y, 10M, 10C and 10K to the intermediate transfer medium; and photoconductor cleaning apparatuses 9Y, 9M, 9C and 9K which are all a latent image carrier cleaning apparatus are provided in the surroundings of the respective photoreceptors 2Y, 2M, 2C and 2K.

The image forming apparatus 1 is also provided with an endless intermediate transfer belt 18 which is the intermediate transfer medium. This intermediate transfer belt 18 is laid across in a tensioned state between drive rollers 12A and 12B and driven rollers 13A and 13D which are separated from each other and counterclockwise provided in a rotatable manner. In view of enhancing the transfer efficiency of transfer of a toner imager to a transfer material 14 such as paper, this intermediate transfer belt 18 is preferably an elastic intermediate transfer belt.

A transfer apparatus 19 from the intermediate transfer belt 18 is provided on the side of the drive rollers 12A and 12B of the intermediate transfer belt 18, and an intermediate transfer belt cleaning apparatus 17 is provided on the side of the driven roller 13A of the intermediate transfer belt 18.

In the transfer apparatus 19, two backup rollers 20A and 20B are provided for the two drive rollers 12A and 12B, respectively, whereby the transfer efficiency can be enhanced by transfer by the two pairs of rollers.

The transfer apparatus 19 has a backup roller nip release apparatus 21 capable of releasing nip by separating the backup rollers 20A and 20B and the intermediate transfer belt 18 from each other, whereby when a portion of the intermediate transfer belt 18 on which a carrier liquid is applied as a dispersant collecting liquid passes, it is possible to prevent deposition of the carrier liquid on the backup rollers 20A and 20B from occurring by the backup roller nip release apparatus 21.

While illustration is omitted, the image forming apparatus 1 of this embodiment is provided with a transfer material storage apparatus for storing a transfer material such as paper in the transfer apparatus 19 and a pair of resist rollers for conveying and supplying the transfer material from this transfer material storage apparatus to the transfer apparatus 19. Similarly, this image forming apparatus 1 is provided with a fixing apparatus for fixing an image of the transfer material to be discharged from the transfer apparatus 19 to the transfer material and a paper discharge tray.

In the image forming apparatus 1 of this embodiment, the respective photoconductors 2Y, 2M, 2C and 2K and the respective development apparatuses 5Y, 5M, 5C and 5K are provided in the color order of Y, M, C and K in the development order. However, the disposition order of these colors of Y, M, C and K can be arbitrarily set up.

Bias voltage with the same polarity as the charge polarity of the liquid developer is applied to each of the charge members 3Y, 3M, 3C and 3K from a non-illustrated power source apparatus. The respective charge members 3Y, 3M, 3C and 3K charge the corresponding photoconductors 2Y, 2M, 2C and 2K, respectively.

The respective exposure apparatuses 4Y, 4M, 4C and 4K form an electrostatic latent image on the corresponding charged photoconductors 2Y, 2M, 2C and 2K, respectively by laser light irradiated from a laser scanning optical system or the like, or irradiation light of a light-emitting device in which LED, EL, etc. is linearly disposed.

A developing solution prepared in a prescribed concentration is supplied into each of developer containers 30Y, 30M, 30C and 30K of the respective development apparatuses 5Y, 5M, 5C and 5K from each of toner preparation tanks 25Y, 25M, 25C and 25K of respective colors. In the toner preparation tanks 25Y, 25M, 25C and 25K of respective colors, toners 51Y, 51M, 5SC and 51K are replenished from toner storage tanks 50Y, 50M, 50C and 50K, respectively together with a carrier liquid 41 from each of carrier liquid storage tanks 40Y, 40M, 40C and 40K.

Each of the liquid developers is supplied into each of anilox rollers 33Y, 33M, 33C and 33K by each of clockwise rotating supply rollers 32Y, 32M, 32C and 32K.

The respective anilox rollers 33Y, 33M, 33C and 33K are counterclockwise rotated, regulate the thickness of each of the supplied liquid developers by regulating blades 34Y, 34M, 34C and 34K and supply it to development rollers 35Y, 35M, 35C and 35K, respectively.

All of the development rollers 35Y, 35M, 35C and 35K are counterclockwise rotated as shown by arrows in FIG. 1 and given a development bias by charge members 36Y, 36M, 36C and 36K, whereby the electrostatic latent images formed on the respective photoconductors 2Y, 2M, 2C and 2K are developed. Subsequently, the liquid developers remaining on the development rollers 35Y, 35M, 35C and 35K are scraped off and removed by corresponding development roller cleaners 37Y, 37M, 37C and 37K constituted of a member such as rubber, which come into contact with each of the surfaces of the development rollers.

The excessive carrier liquids contained in the developer images formed on the development rollers 35Y, 35M, 35C and 35K are recovered by the squeeze rollers 7Y, 7M, 7C and 7K and sent to the respective toner preparation tanks 25Y, 25M, 25C and 25K.

In the invention, various liquid developers can be used as liquid developers 31Y, 31M, 31C and 31K to be stored in the respective developer containers 30Y, 30M, 30C and 30K. As one example thereof, a liquid developer containing from 10 to 30% by mass of a toner particle of from about 0.1 to 5 μm obtained by dispersing a coloring agent such as pigments in a thermoplastic resin and from 0.1 to 10% bymass of adispersant, with a balance being a carrier liquid can be used.

As the carrier liquid, in case of a liquid developer with low viscosity and low concentration, for example, insulating carrier liquids such as ISOPAR (a registered trademark) which is an isoparaffin based organic solvent can be used. In case of a liquid developer with high viscosity and high concentration, insulating carrier liquids, for example, silicone oils having a flash point of 210° C. or higher such as phenylmethylsiloxane, dimethylpolysiloxane and polydimethylcyclosiloxane, mineral oils, aliphatic saturated hydrocarbons having a relatively low viscosity and a boiling point of 130° C. or higher and a viscosity at 40° C. of 3 mPa·s such as liquid paraffins, normal paraffins, vegetable oils and higher fatty acid esters can be used.

The dispersant is blended for the purpose of enhancing the dispersibility of the toner in the carrier liquid, and a substance having an excellent affinity for both the toner and the carrier liquid is used. As one example, a polymer having an acid group, an amine group, etc. in a chemical structure is used.

Examples of the polymer having an acid group include polyacrylic acid and hydrocarbon soluble copolymers thereof, polymethacrylic acid and hydrocarbon soluble copolymers thereof, polystyrenesulfonic acid and hydrocarbon soluble copolymers thereof, polyvinylsulfonic acid and hydrocarbon soluble copolymers thereof, a styrene/maleic acid copolymer and hydrocarbon soluble derivatives thereof, and a vinyl methyl ether/maleic acid copolymer and hydrocarbon soluble derivatives thereof. These polymers preferably have a weight average molecular weight of from 1,000 to 100,000.

Specific examples thereof include hydrocarbon soluble copolymers containing acrylic acid, methacrylic acid or a mixture thereof (for example, a trade name: SOLSPERSE 3000 (manufactured by The Lubrizol Corporation) and a trade name: SOLSPERSE 28000 (manufactured by The Lubrizol Corporation))

Examples of the dispersant composed of an amine group-containing polymer include polyvinylpyrrolidone, polyamines, polyethyleneimine, amine group-containing poly(meth)acrylates and a copolymer of an amine group-containing alkyl(meth)acrylate and a (meth)acrylate and hydrocarbon soluble derivatives thereof. The (meth)acrylate as referred to herein means one containing at least one of an acrylate and a methacrylate.

Specific examples thereof include hydrocarbon soluble copolymers derived from a tertiary amine monomer such as dimethylaminoethyl methacrylate (for example, a trade name: SOLSPERSE 13940 (manufactured by The Lubrizol Corporation)).

The dispersant is able to control the viscosity of the liquid developer depending upon its structure and addition amount. The addition amount of the dispersant is from 0.01 to 20% by mass, and preferably from 0.1 to 10% by mass relative to the liquid developer. When the addition amount falls within this range, it is possible to avoid unevenness in film thickness of the developer from occurring and to achieve good image formation free from unevenness in concentration.

The toner images formed on the respective photoconductors 2Y, 2M, 2C and 2K are transferred to the intermediate transfer belt 18 in the transfer apparatus 10Y, 10M, 10C and 10K. The respective transfer apparatuses are provided with transfer backup rollers 15Y, 15M, 15C and 15K which bring the intermediate transfer belt 18 into contact with the respective photoconductors 2Y, 2M, 2C and 2K. A transfer bias with reverse polarity to the charge polarity of the toner particle of, for example, from −200 V to −400 V is applied to the respective backup rollers 15Y, 15M, 15C and 15K, whereby the developer images on the respective photoconductors 2Y, 2M, 2C and 2K are transferred to the intermediate transfer belt 18.

Each of the photoconductor cleaning apparatuses 9Y, 9M, 9C and 9K is composed of a photoconductor cleaner 91 and a photoconductor cleaner collecting liquid storage container 92. All of the respective photoconductors 91 are composed of an elastic body such as rubber and brought into contact with the surfaces of the corresponding respective photoconductors 2Y, 2M, 2C and 2K, thereby scraping off and removing the liquid developers remaining on the photoconductors 2Y, 2M, 2C and 2K. The photoconductor cleaner collecting liquid storage container 92 recovers the developer scraped off from each of the photoconductors 2Y, 2M, 2C and 2K by the photoconductor cleaner 91 and stores it. The developer stored in each of the photoconductor cleaning apparatuses 9Y, 9M, 9C and 9K is recovered into a developer collecting container 90.

The image forming apparatus 1 of the invention has a dispersant collecting liquid application unit 6, and an application roller 65 provided in the dispersant collecting liquid application unit 6 comes into contact with the intermediate transfer belt 18 and applies a dispersant collecting liquid 61. Though the dispersant collecting liquid application unit 6 can be disposed in a position where the application roller 65 comes into contact with the intermediate transfer belt 18 positioned in an upstream part of the photoconductor, it is preferable that the application roller 65 is provided on the opposite surface to the contact part of the driven roller 13A of the intermediate transfer belt 18 as shown in FIG. 1.

In this way, by disposing the application roller 65 so as to come into contact with the intermediate transfer belt 18 on the opposite surface to the contact part of the driven roller 13A, an exclusive member for bringing the application roller 65 into contact with the intermediate transfer belt 18 is not necessary.

The dispersant collecting liquid 61 is replenished from a dispersant collecting liquid storage tank 60, formed into a prescribed thickness by a supply roller 63 and a regulating blade 64 within a dispersant collecting liquid container 62 and then supplied into the dispersant collecting liquid application roller 65. The dispersant collecting liquid 61 dissolves and dilutes the dispersant remaining on the intermediate transfer belt 18. The liquid having the dispersant dissolved therein is removed by the intermediate transfer belt cleaning apparatus 17 and sent to the developer collecting container 90.

As described previously, when the dispersant collecting liquid applied on the intermediate transfer belt 18 reaches the secondary transfer apparatus 19, the backup roller nip release apparatus 21 provided in the secondary transfer apparatus 19 is actuated, whereby deposition of the dispersant collecting liquid 61 on the backup rollers 20A and 20B can be prevented from occurring.

The dispersant collecting liquid 61 also moves into the respective photoconductors 2Y, 2M, 2C and 2K from the side of the intermediate transfer belt 18 in the respective transfer apparatuses 10Y, 10M, 10C and 10K.

Accordingly, in the case where it is a principal object to remove the dispersant remaining on the intermediate transfer belt 18, it is preferable to prevent the movement of the dispersant collecting liquid 61 into the side of each of the photoconductors 2Y, 2M, 2C and 2K from occurring.

For preventing the movement of the dispersant collecting liquid 61 into the respective photoconductors 2Y, 2M, 2C and 2K from occurring, there can be exemplified a method for releasing nip between each of the photoconductors 2Y, 2M, 2C and 2K and the intermediate transfer belt 18 in each part of the transfer apparatuses 10Y, 10M, 10C and 10K, namely separating the both from each other. By making the peripheral speed of the intermediate transfer belt 18 faster than that at the time of image formation, it is possible to reduce the amount of movement of the dispersant collecting liquid 61 into each of the photoconductors 2Y, 2M, 2C and 2K from the side of the intermediate transfer belt 18.

On the other hand, by making the dispersant collecting liquid 61 positively move into each side of the photoconductors 2Y, 2M, 2C and 2K from the side of the intermediate transfer belt 18, it is also possible to perform the removal of the dispersant from the intermediate transfer belt 18 and the removal of the dispersant from each of the photoconductors 2Y, 2M, 2C and 2K at the same time.

Figure 2A:
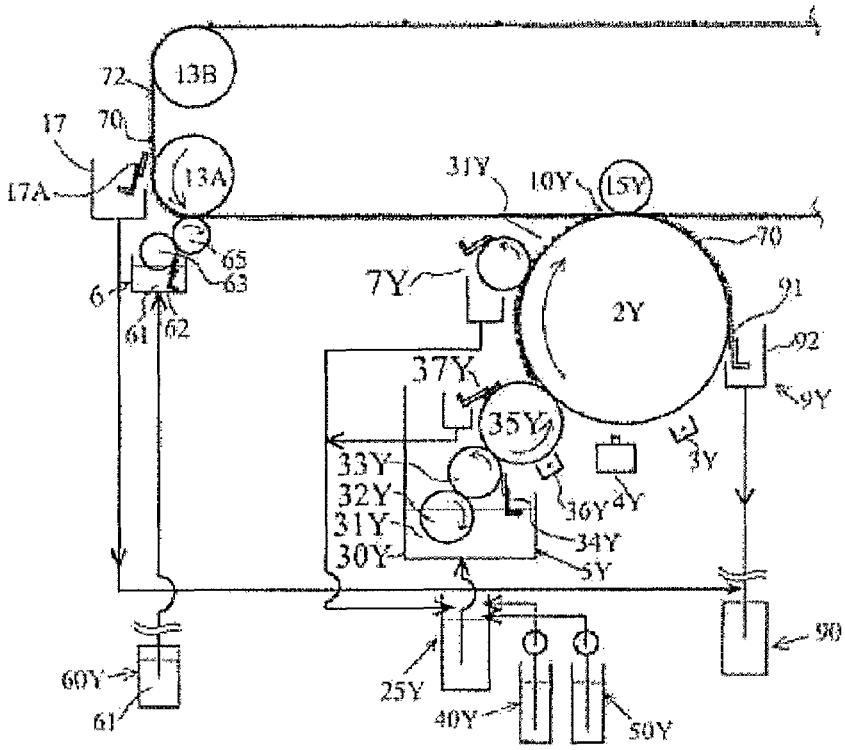
FIGS. 2A and 2B are each a view explaining a collecting mechanism of a dispersant of an image forming apparatus of the invention.
Figure 2B:
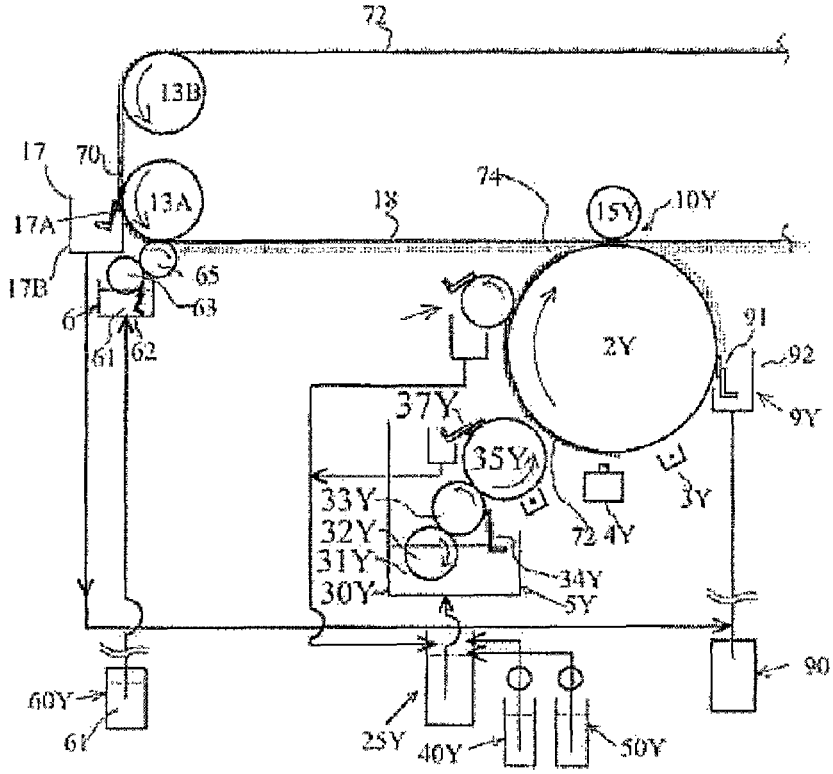

FIGS. 2A and 2B are each a view explaining a collecting mechanism of the dispersant of the image forming apparatus of the invention.

FIG. 2A is a view explaining the action at the time of development.

The photoconductor 2Y is charged by the charge member 3Y while rotating clockwise and then exposed by the exposure apparatus 4Y to form an electrostatic latent image.

Subsequently, in the development apparatus 5Y, the carrier liquid 41 to be supplied from the carrier liquid storage tank 40Y and the toner 51Y to be supplied from the toner storage tank 50Y are prepared into a developer having a prescribed concentration in the developing preparation tank 25Y, which is then supplied into the developer container 30Y. The supplied liquid developer 31Y is supplied by the supply roller 32Y and the anilox roller 33Y, and the electrostatic latent image is developed by the development roller 35Y.

The developer image on the photoconductor 2Y having an electrostatic latent image developed therein is squeezed by the squeeze apparatus 7Y to recover the excessive carrier liquid, and the recovered developing solution is recovered into the developing solution preparation tank 25Y.

Subsequently, the formed developer image is given a transfer bias by the backup roller 15Y in the transfer apparatus 10Y, transferred onto the intermediate transfer belt 18 which is an intermediate transfer medium, transferred on a transfer material such as paper in the transfer apparatus 10Y, fixed by a fixing apparatus and then taken out from the image forming apparatus.

A residual developer 70 remaining on the photoconductor 2 after the transfer is removed by the photoconductor cleaner 91 provided in the photoconductor cleaning apparatus 9Y, recovered in the photoconductor cleaner collecting liquid storage container 92 and then sent to the developer collecting container 90.

A solid component in the residual developer 70 is removed by the photoconductor cleaning apparatus 9Y.

After finishing of the transfer from the intermediate transfer belt 18, the residual developer 70 remaining on the intermediate transfer belt 18 is removed by an intermediate transfer belt cleaning member 17A provided in the intermediate transfer belt cleaning apparatus 17, recovered in an intermediate transfer belt cleaning container 17B and then sent to the developer collecting container 90.

Though the solid component in the residual developer 70 is removed by the intermediate transfer belt cleaning apparatus 17, the dispersant dissolved in the carrier liquid is not completely removed by the intermediate transfer belt cleaning member 17A provided in the intermediate transfer belt cleaning apparatus 17 but remains as a dispersant-containing residual liquid 72 on the surface of the intermediate transfer belt 18.

On the other hand, in the image forming apparatus of the invention, as shown in FIG. 2B, after developing the electrostatic latent image of the photoreceptor 2Y by the development apparatus 5Y, the dispersant collecting liquid 61 is applied on the intermediate transfer belt 18 from the application roller 65 provided in the dispersant collecting liquid application unit 6.

The dispersant in the residual liquid 72 on the intermediate transfer belt 18 is dissolved in the applied dispersant collecting liquid 61 and further dissolved in and diluted with the dispersant collecting liquid 61 to form a dispersant liquid diluted layer 74.

Following the rotation of the intermediate transfer belt 18, the dispersant liquid diluted layer 74 reaches the intermediate transfer belt cleaning apparatus 17 and is removed by the intermediate transfer belt cleaning member 17A, recovered by the intermediate transfer belt cleaning container 17B and then recovered into the developer collecting container 90.

After finishing of the application process of the dispersant collecting liquid on the intermediate transfer belt and the dispersant collecting process, the development process is carried out as shown in FIG. 2A.

In the light of the above, by repeating the development process as shown in FIG. 2A and the dispersant collecting process as shown in FIG. 2B, the image formation with high quality can be achieved. Though the dispersant collecting process may be carried out alternately with the development process, the dispersant collecting process may be carried out once relative to the plurality of the development process and may be carried out at the time of start or finishing of the development process.

Figure 3A:
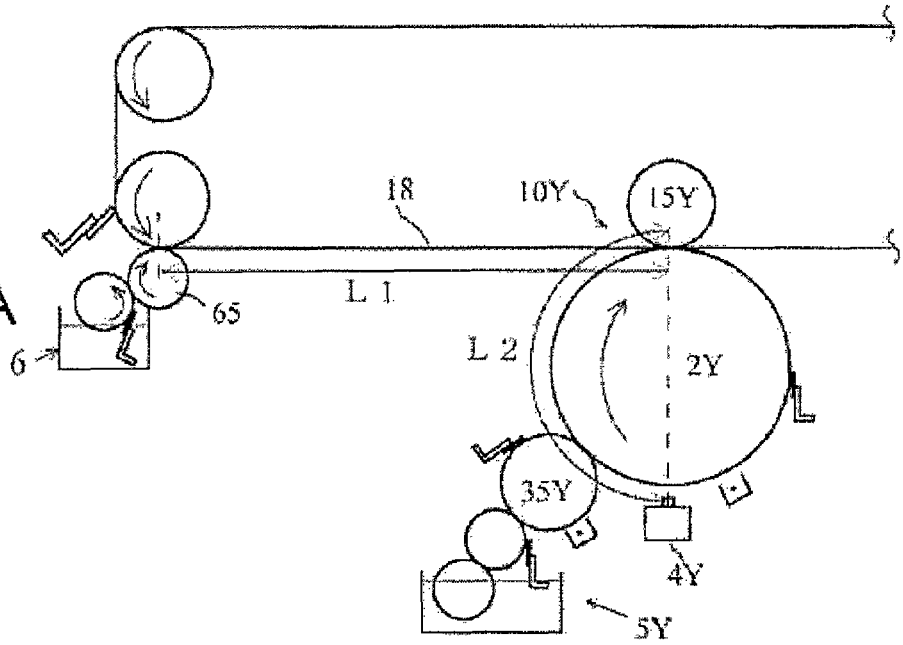
FIGS. 3A and 3B are each a view explaining the positional relationship of an application part of a dispersant in an image forming apparatus of an embodiment according to the invention.
Figure 3B:
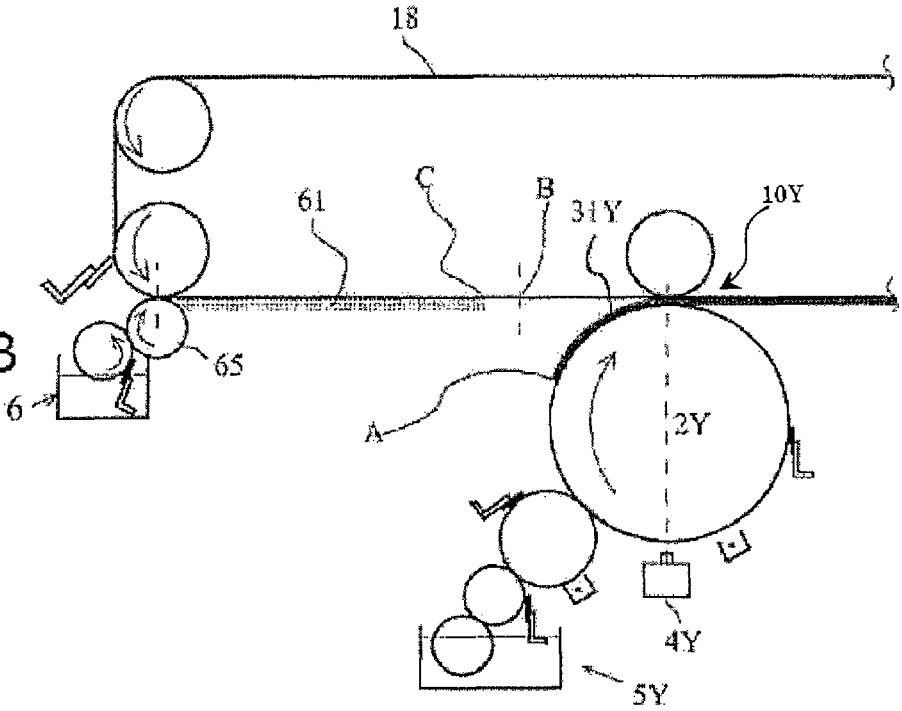

FIGS. 3A and 3B are each a view explaining the positional relationship of the application part of the dispersant in the image forming apparatus of the invention.

FIG. 3A is a view showing the relationship of a distance L1 between the application roller 65 of the dispersant collecting liquid application unit 6 and a nip part of a primary transfer part 10Y and a distance L2 between the exposure apparatus 4Y of the photoconductor 2Y and the nip part of the transfer part 10 to the intermediate transfer belt 18 and shows the state that in case of forming an image for every page, an electrostatic latent image in a corresponding position of a rear end of a printable region is formed in the photoconductor 2Y.

That is, when the rear end position of the electrostatic latent image corresponding to the rear end of the image is exposed, L2 expresses a distance from the nip part of the transfer apparatus 10Y to the intermediate transfer belt 18 to the rear end of the image.

On the other hand, L1 expresses a distance from the application roller 65 to the nip part.

Accordingly, when there is the relationship of (L1>L2), it is possible to apply the dispersant collecting liquid in such a manner that a portion to be applied with the dispersant collecting liquid does not overlap in a position corresponding to the rear end of the image on the intermediate transfer belt 18 without enlarging the length of a portion where the dispersant collecting liquid is not applied on the intermediate transfer belt 18.

FIG. 3B shows that in the transfer apparatus 10Y to the intermediate transfer belt 18, a rear end position A of the image of the developer image composed of the developer 31Y formed on the photoconductor 2Y is transferred to a rear end potion B of the image on the intermediate transfer belt 18, whereas a tip end position C of the application part of the dispersant collecting liquid 61 is positioned slightly behind the B position.

That is, it is shown that the control is performed such that application of the dispersant collecting liquid in which the dispersant in the liquid developer is soluble is started from the C position located on the upstream side as compared with the B position which is the image forming position on the rotatable intermediate transfer belt 18 to which the developer image on the photoconductor 2Y to which an image is first transferred to the intermediate transfer medium 18 is transferred, by the dispersant collecting liquid application roller 65 of the application unit 6.

FIGS. 4A to 4D are each a view explaining the control method in the image forming apparatus of the invention.

Figure 4A:
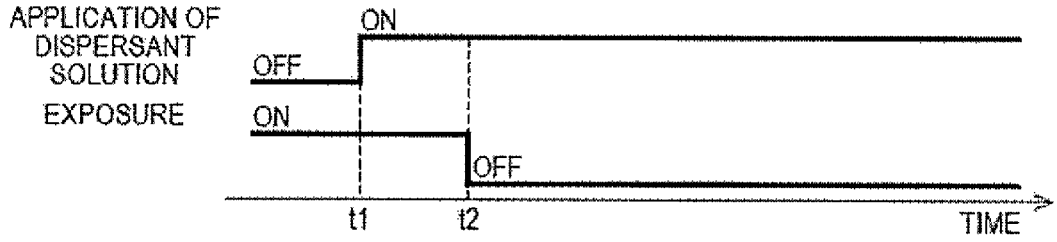
FIGS. 4A to 4D are each a view explaining a control method in an image forming apparatus of the embodiment according to the invention.

FIG. 4A shows an embodiment in which the application action of the dispersant collecting liquid is started at t1, and the exposure action is finished at t2.

For example, under the following condition, the rear end of the printed image must pass through the transfer nip until the tip end of the application part of the dispersant collecting liquid reaches the transfer nip to the intermediate transfer belt. Therefore, a difference between t1 and t2 must be 0.7 seconds.

Printing speed, 40 sheets per one minute of A4-size paper: 214 mm/sec

Figure 4B:
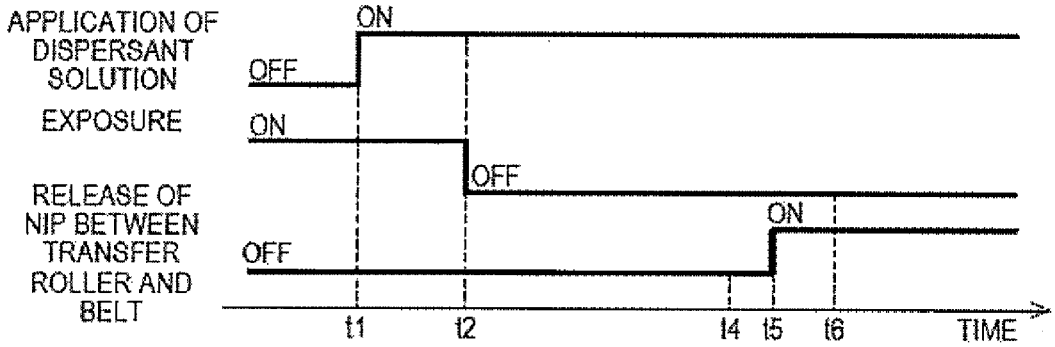

Distance between application roller and transfer nip to intermediate transfer medium: 140 mm Distance between exposure part and primary transfer part: 125.6 mm FIG. 4B shows that after the rear end of the image passes through the nip between the transfer roller to the transfer material and the intermediate transfer belt at t4, the nip between the transfer roller to the transfer material and the intermediate transfer belt is released at t5. Furthermore, even after the tip end of the application part of the dispersant collecting liquid passes at t6, the release state is kept until passing of the application part of the dispersant collecting liquid is finished, and after elapsing a prescribed time after the application part of the dispersant collecting liquid has passed, the prescribed nip is performed.

Figure 4C:
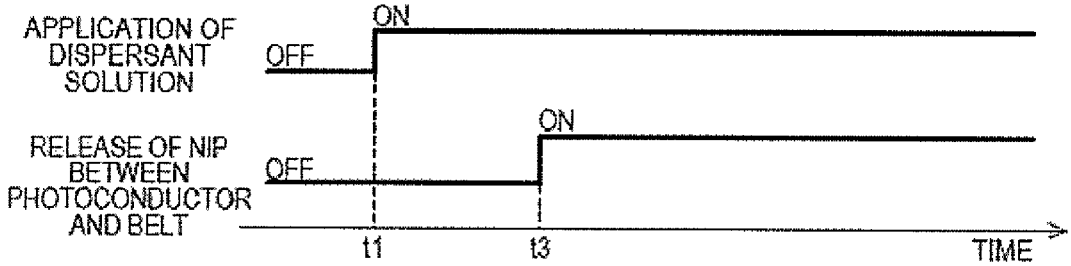

FIG. 4C is a view explaining a point of time t3 of nip release between the photoconductor and the intermediate transfer belt in the transfer part to the intermediate transfer belt. t3 is set up at a time which is shorter than a time obtained by adding a time before the tip end of the application part of the dispersant collecting liquid reaches the transfer nip to the intermediate transfer medium from the point of time t1 of starting the application of the dispersant collecting liquid.

Figure 4D:
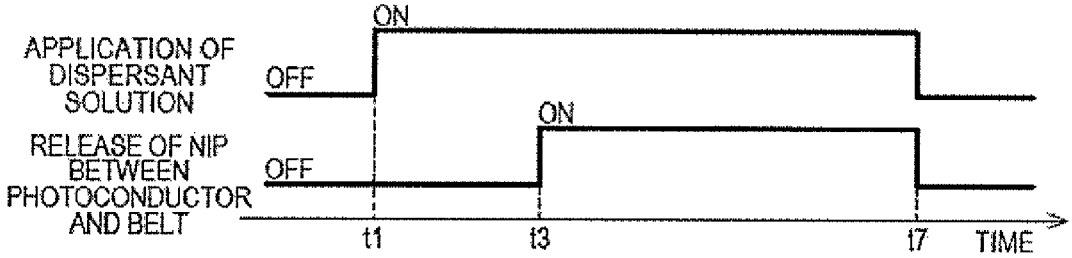

FIG. 4D shows that after rotating the photoconductor of a final stage at least one round until t3 for applying the dispersant collecting liquid in a state that the photoconductor and the intermediate transfer belt come into contact with each other, the nip between the photoconductor and the intermediate transfer belt is released and that the dispersant collecting liquid is further applied in an amount corresponding to one round of the belt on the intermediate transfer belt until t7.

As a result, a cleaning step of cleaning the intermediate transfer belt can be performed by a cleaning effect to be brought due to the application of the dispersant collecting liquid on the photoconductor and the subsequent application of the dispersant collecting liquid on the belt.

Figure 5:
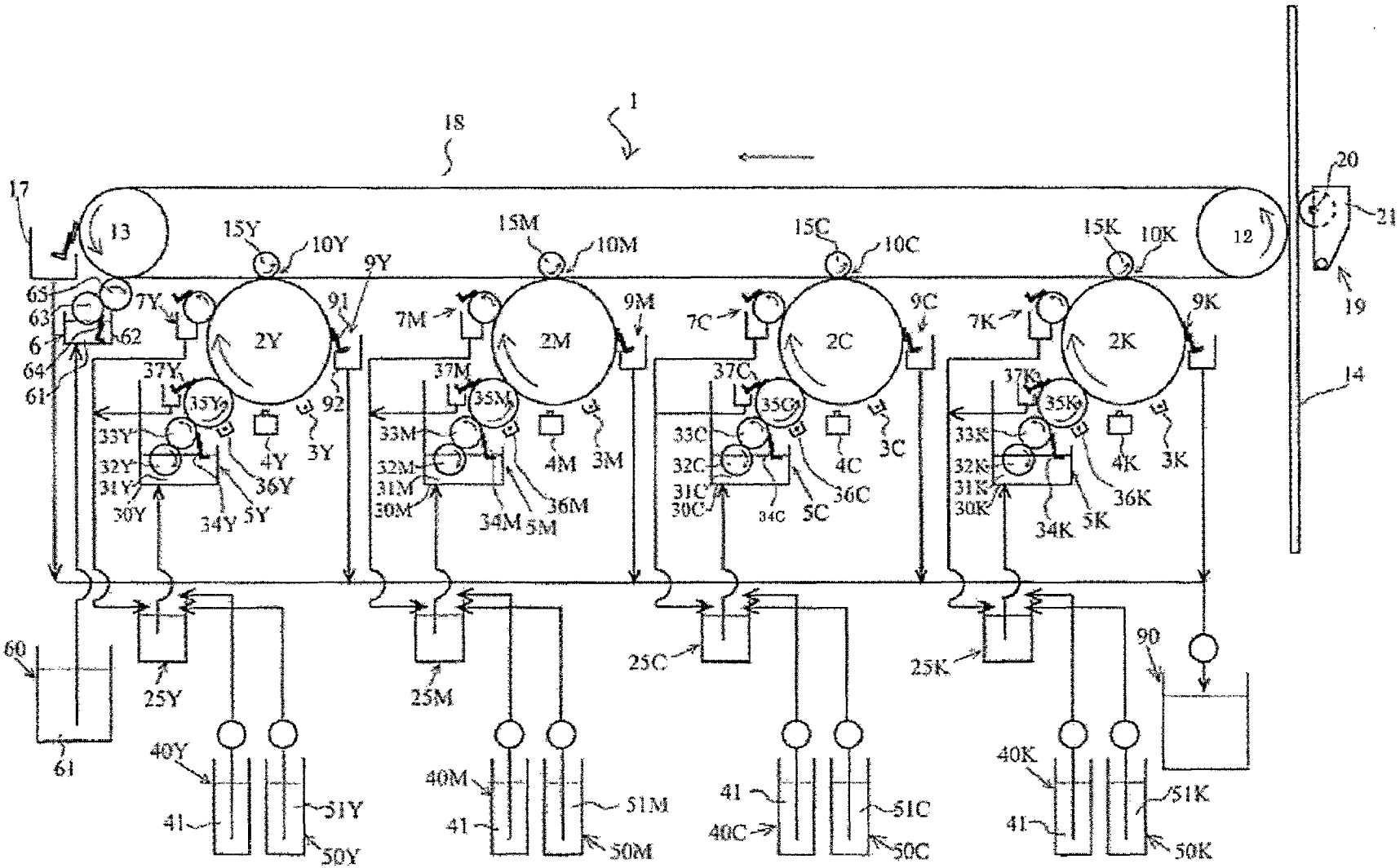
FIG. 5 is a view explaining an embodiment of an image forming apparatus according to the invention.

FIG. 5 is a view explaining another embodiment of the image forming apparatus according to the invention.

In the image forming apparatus 1 as explained in FIG. 1, the intermediate transfer belt 18 is laid across in a tensioned state between the drive rollers 12A and 12B and the driven rollers 13A and 13B which are separated from each other and counterclockwise provided in a rotatable manner in FIG. 1. On the other hand, though the image forming apparatus as shown in FIG. 5 is different from that as shown in FIG. 1 at the point that the intermediate transfer belt 18 is laid across in a tensioned state between a drive roller 12 and a driven roller 13 and counterclockwise provided in a rotatable manner, it forms an image in the same manner as in the image forming apparatus as shown in FIG. 1.

Figure 6:
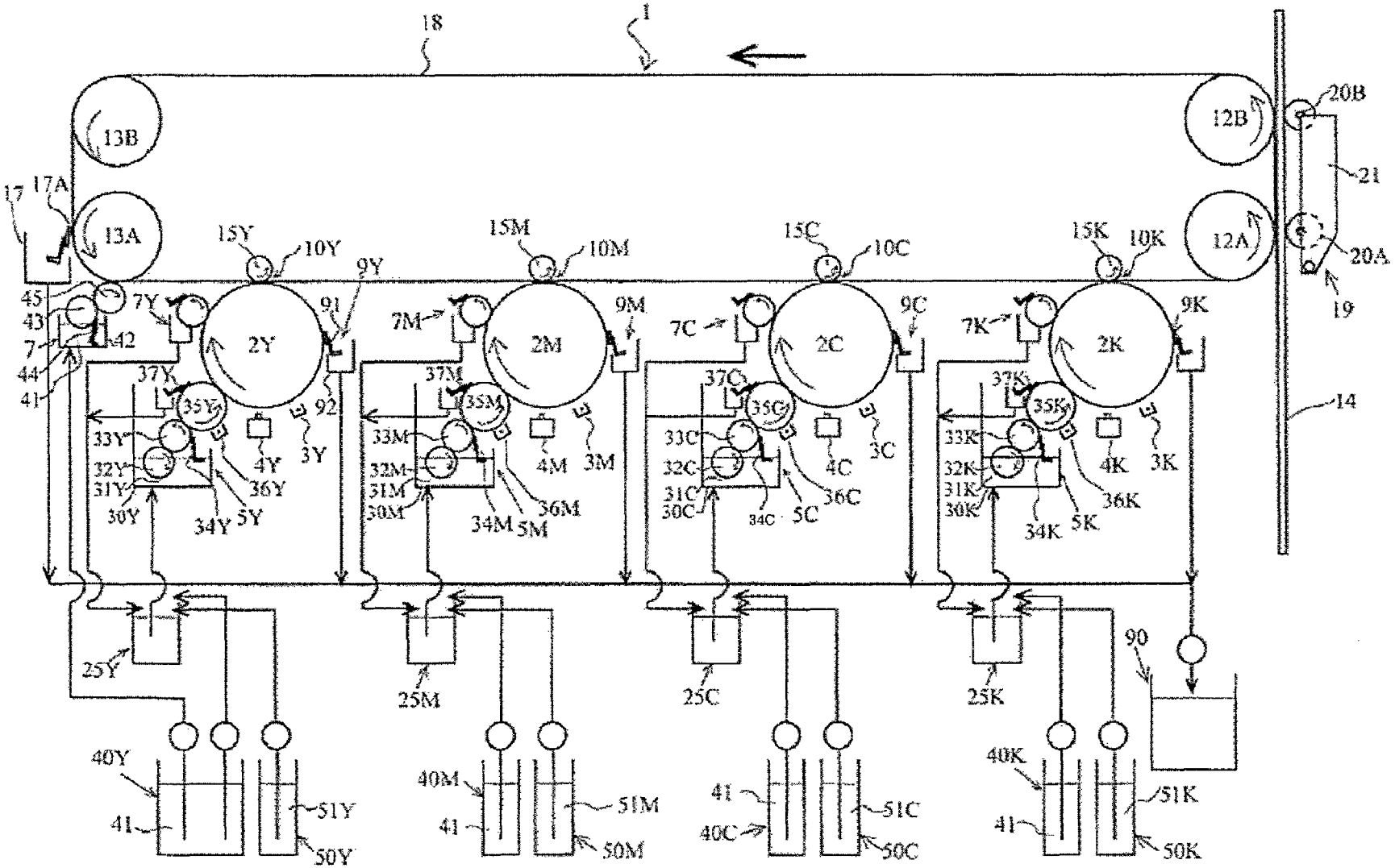
FIG. 6 is a view explaining an embodiment of an image forming apparatus according to the invention.

FIG. 6 is a view explaining another embodiment of the image forming apparatus according to the invention.

FIG. 6 is a view explaining an image forming apparatus for supplying the carrier liquid as the dispersant collecting liquid into the application unit to dissolve and dilute the dispersant and then separating it.

The image forming apparatus as shown in FIG. 6 is different from the image forming apparatus as shown in FIG. 1 at the point that the carrier liquid 41 to be supplied from the carrier liquid storage tank 40Y which is provided for the purpose of preparing a liquid developer is utilized as the dispersant collecting liquid.

Similar to the image formulation apparatus 1 as shown in FIG. 1, in the image formulation apparatus 1 as shown in FIG. 6, the respective photoconductors 2Y, 2M, 2C and 2K are disposed in a tandem type, and an application roller 45 of a carrier liquid application unit 7 provided as a dispersant collecting liquid application unit comes into contact with the intermediate transfer belt 18 to apply the carrier liquid 41 as the dispersant collecting liquid.

The carrier liquid 41 is replenished from the carrier liquid storage tank 40Y, formed into a prescribed thickness by a supply roller 43 and a regulating blade 44 within a carrier liquid container 42 and then supplied to the carrier liquid application roller 45.

The carrier liquid 41 applied on the intermediate transfer belt 18 by the carrier liquid application roller 45 forms a dispersant diluted layer in which the dispersant remaining on the intermediate transfer belt 18 is diluted.

The dispersant diluted layer reaches the intermediate transfer belt cleaning apparatus 17 and is removed by the intermediate transfer belt cleaning member 17A, recovered by the intermediate transfer belt cleaning container 17B and then sent to the developer collecting container 90.

In this way, in the image forming apparatus as shown in FIG. 6, since the carrier liquid prepared for the preparation of a liquid developer is used, it is not necessary to prepare a carrier liquid for dispersant collecting separately from the carrier liquid for preparing a liquid developer.

Figure 7:
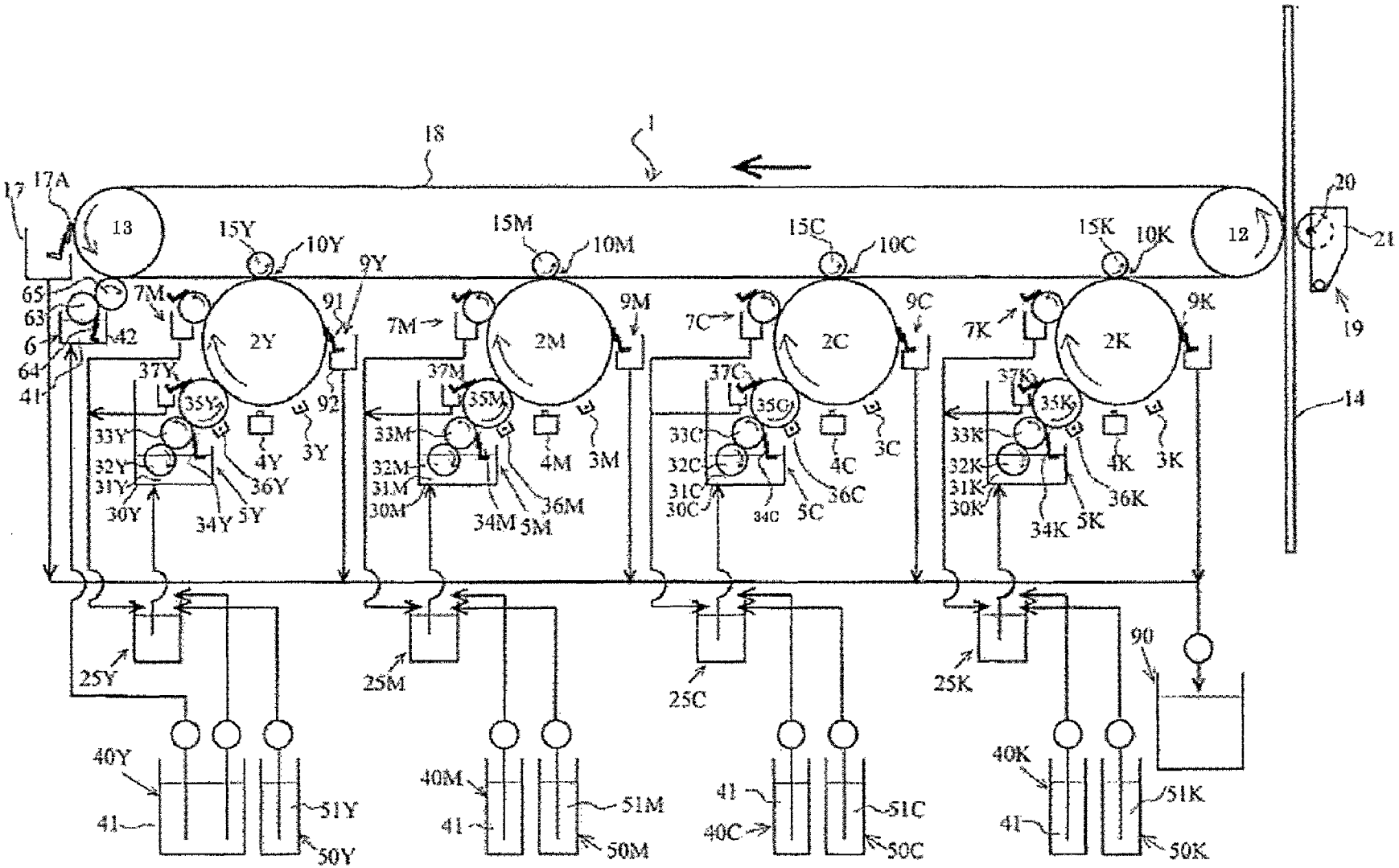
FIG. 7 is a view explaining an embodiment of an image forming apparatus according to the invention.

FIG. 7 is a view explaining another embodiment of the image forming apparatus according to the invention.

In the image forming apparatus 1 as explained in FIG. 6, the intermediate transfer belt 18 is laid across in a tensioned state between the drive rollers 12A and 12B and the driven rollers 13A and 13B which are separated from each other and counterclockwise provided in a rotatable manner. On the other hand, though the image forming apparatus as shown in FIG. 7 is different from that as shown in FIG. 6 at the point that the intermediate transfer belt 18 is laid across in a tensioned state between a drive roller 12 and a driven roller 13 and counterclockwise provided in a rotatable manner, it forms an image in the same manner as in the image forming apparatus as shown in FIG. 6.

Figure 8:
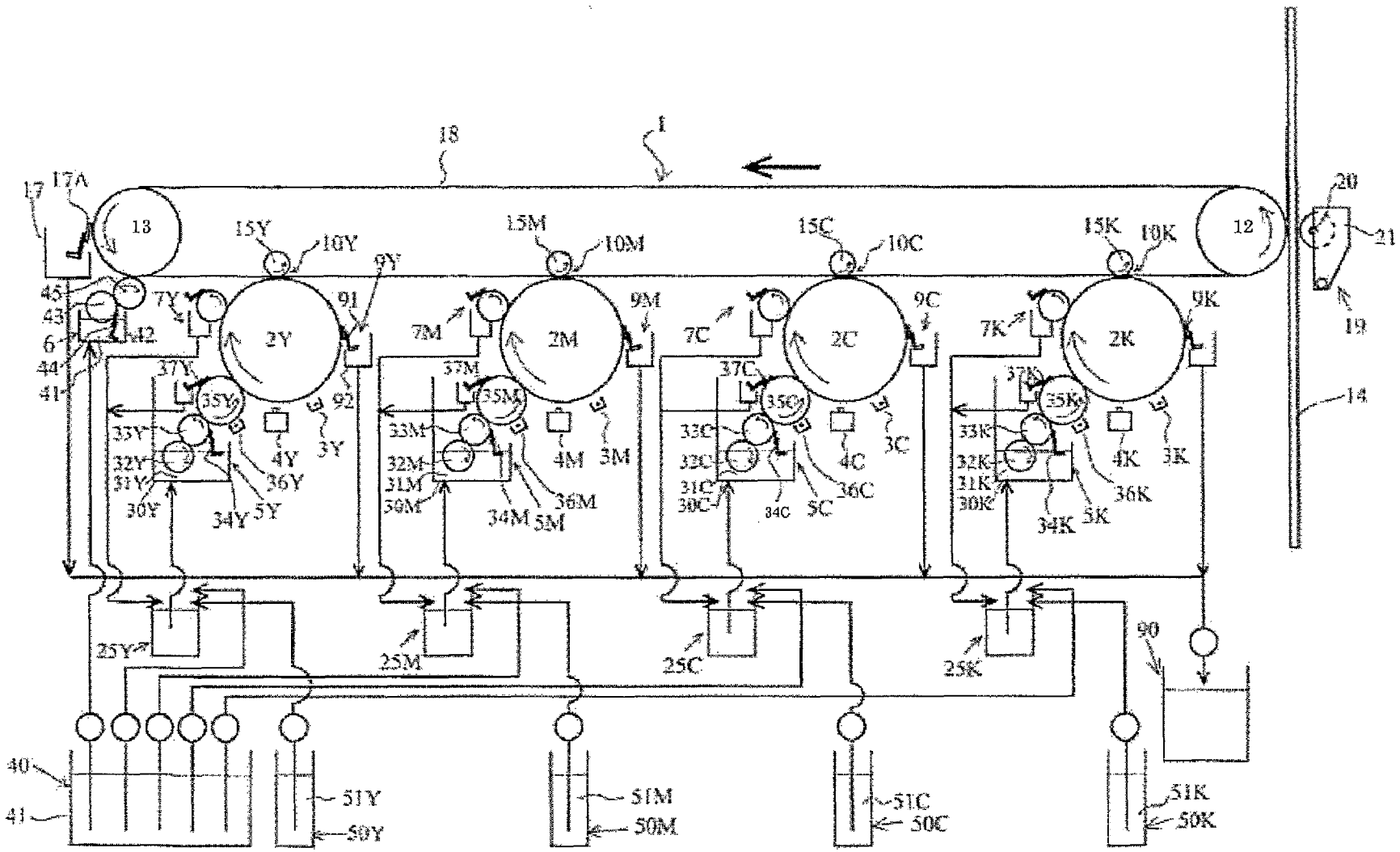
FIG. 8 is a view explaining an embodiment of an image forming apparatus according to the invention.

FIG. 8 is a view explaining another embodiment of the image forming apparatus according to the invention.

The image forming apparatus as shown in FIG. 8 is different from that as shown in FIG. 7 at the point that the carrier liquid 41 to be supplied from the carrier liquid storage tank 40 in which all of the dispersant collecting liquid and the carrier liquid for preparing a liquid developer of each color are common is used.

The image forming apparatus as shown in FIG. 8 has a characteristic feature that the carrier liquid is supplied from the carrier liquid storage tank 40 to the dispersant collecting application unit 6 and applied on the surface of the intermediate transfer belt 18 and at the same time, is supplied to each of the liquid developer preparation tanks 25Y, 25M, 25C and 25K of respective colors and mixed with the toner, whereby it is utilized for the preparation of a liquid developer having a prescribed concentration.

The image forming apparatus as shown in FIG. 8 has a characteristic feature that it is not necessary to separately prepare a dispersant collecting liquid or to prepare a carrier liquid for every color.

What is claimed is:

1. A control method of an image forming apparatus including:

a latent image carrier;

a development apparatus for developing a liquid developer containing a toner, a carrier liquid and a dispersant soluble in the carrier liquid therein on the latent image carrier;

an intermediate transfer medium to which a developer image developed on the latent image carrier is transferred;

a transfer apparatus for transferring the developer image on the intermediate transfer medium to a transfer material; and a dispersant collecting liquid application unit for applying a dispersant collecting liquid on the intermediate transfer medium, the method comprising:

performing the control such that after finishing transfer of the developer image onto the intermediate transfer medium and to the transfer material, application of the dispersant collecting liquid on the intermediate transfer medium is started by the dispersant collecting liquid application unit.

2. The control method of an image forming apparatus according to claim 1, wherein the transfer apparatus has two transfer rollers that are controlled such that they are separated from the intermediate transfer medium during a time after transferring the developer image onto the intermediate transfer medium until starting the application of the dispersant collecting liquid on the intermediate transfer medium by the dispersant collecting liquid application unit.

3. The control method of an image forming apparatus according to claim 2, wherein separation between the transfer rollers and the intermediate medium is continued until an action for removing the dispersant by the application of the dispersant collecting liquid is finished.

4. The control method of an image forming apparatus according to claim 1, wherein after finishing of the transfer from the latent image carrier to the intermediate transfer medium, a rotating speed of the intermediate transfer medium is faster than a rotating speed of the intermediate transfer medium at the time of transferring the developer image from the latent image carrier to the intermediate transfer medium.

5. The control method of an image forming apparatus according to claim 1, wherein the latent image carrier is separated from the intermediate transfer medium before an application starting position of the dispersant collecting liquid applied by the dispersant liquid collecting liquid application unit on the intermediate transfer medium reaches a transfer part for transferring the intermediate transfer medium developer image from the latent image carrier.

6. The control method of an image forming apparatus according to claim 1, wherein after rotating in a state that the latent image carrier and the intermediate transfer medium come into contact with each other until the dispersant collecting liquid is applied on the latent image carrier one or more rounds, the dispersant collecting liquid is applied on the intermediate transfer medium by rotating the intermediate transfer medium one or more rounds while separating the latent image carrier and the intermediate transfer medium from each other.

7. An image forming apparatus comprising:

a latent image carrier;

a development apparatus in which rotatable development rollers for conveying a liquid developer containing a toner for developing an electrostatic latent image, a carrier liquid and a dispersant which is soluble in the carrier liquid develop a latent image of the latent image carrier;

a rotatable intermediate transfer medium to which a developer image on the latent image carrier is transferred;

an intermediate transfer medium cleaning apparatus for cleaning the intermediate transfer medium; and an application unit for applying a dispersant collecting liquid on the intermediate transfer medium, such that after finishing transfer of the developer image onto the intermediate transfer medium and to the transfer material, the application unit starts applying the dispersant collecting liquid on the intermediate transfer medium.

8. The image apparatus according to claim 7, further comprising:

an exposure apparatus for forming the electrostatic latent image, wherein the application unit has an application roller for applying the dispersant collecting liquid, and a relationship of $L1 > L2$ is satisfied, where $L1$ is a distance between a contact position of the application roller and the intermediate transfer medium and a nip part of the latent image carrier and the intermediate transfer medium, and $L2$ is a distance between an exposure position on the latent image carrier by the exposure apparatus and the nip part.

* * * * *